US012296220B1

(12) United States Patent
Tabrizizadeh

(10) Patent No.: US 12,296,220 B1
(45) Date of Patent: May 13, 2025

(54) SHOULDER HARNESS EXERCISE DEVICE WITH SPRING-LOADED FOOT RESTS

(71) Applicant: Sadegh Tabrizizadeh, Spring Valley, NY (US)

(72) Inventor: Sadegh Tabrizizadeh, Spring Valley, NY (US)

( * ) Notice: Subject to any disclaimer, the term of this patent is extended or adjusted under 35 U.S.C. 154(b) by 193 days.

(21) Appl. No.: 18/356,433

(22) Filed: Jul. 21, 2023

(51) Int. Cl.
*A63B 21/00* (2006.01)
*A63B 21/02* (2006.01)
*A63B 71/00* (2006.01)

(52) U.S. Cl.
CPC ..... *A63B 21/4025* (2015.10); *A63B 21/023* (2013.01); *A63B 21/4007* (2015.10); *A63B 21/4034* (2015.10); *A63B 21/4043* (2015.10); *A63B 71/0036* (2013.01); *A63B 2225/685* (2013.01)

(58) Field of Classification Search
CPC ..... A63B 21/00058; A63B 21/00065; A63B 21/023; A63B 21/04; A63B 21/0407; A63B 21/0414; A63B 21/0421; A63B 21/0428; A63B 21/0435; A63B 21/0442; A63B 21/4007; A63B 21/4025; A63B 21/4034; A63B 21/4043; A63B 23/02; A63B 23/0205; A63B 23/0211; A63B 23/0216; A63B 23/0222; A63B 71/0036
See application file for complete search history.

(56) References Cited

U.S. PATENT DOCUMENTS 1,618,273 A * 2/1927 Davidson ..... A63B 21/4003 482/124
2,467,943 A 4/1949 Mikell
4,588,186 A * 5/1986 Calabrese ..... A63B 21/4007 482/131
4,591,150 A * 5/1986 Mosher ..... A63B 21/1663 482/125
5,042,799 A * 8/1991 Stanley ..... A63B 21/4005 482/114
5,046,726 A * 9/1991 Van Straaten ..... A63B 21/05 482/125
5,122,107 A * 6/1992 Gardner ..... A63B 23/0211 482/140
5,328,433 A * 7/1994 Berman ..... A63B 23/0211 482/122
D358,625 S * 5/1995 Enriquez, Jr. ..... D29/101.1
5,839,999 A * 11/1998 Pflugner ..... A63B 21/4025 482/125
5,993,361 A * 11/1999 Paoli ..... A63B 21/4007 482/121

(Continued)

*Primary Examiner* — Gary D Urbiel Goldner
(74) *Attorney, Agent, or Firm* — QuickPatents; Kevin Prince

(57) ABSTRACT

The present invention relates to an exercise device for a person, comprising a shoulder harness adapted to fit around the shoulders of the person, a rigid, elongated member having a first end and a second opposing end, and at least one spring mechanism having a proximal end and a distal end. The proximal end of the spring mechanism is configured for attaching with the rigid, elongated member or the shoulder harness. At least one foot rest having two opposing ends is connected with the distal end of at least one of the spring mechanisms. The person can press against the at least one foot rest with his feet to perform exercises while the shoulder harness is fitted around the shoulders of the person.

17 Claims, 8 Drawing Sheets

(56) References Cited

U.S. PATENT DOCUMENTS

| | | | | |
|---|---|---|---|---|
| 7,128,699 | B2 * | 10/2006 | Hsu | A63B 21/0004 482/79 |
| 7,998,041 | B1 * | 8/2011 | Johnson | A63B 21/0552 482/124 |
| 10,758,771 | B1 * | 9/2020 | Cranke | A63B 21/4015 |
| 10,926,124 | B2 * | 2/2021 | Marti | A61H 1/0266 |
| 11,318,341 | B2 * | 5/2022 | Marti | A63B 21/00185 |
| 11,331,529 | B1 | 5/2022 | Cranke | |
| 11,980,584 | B2 * | 5/2024 | Gigstad | A61H 3/00 |
| 12,042,708 | B1 * | 7/2024 | Waters, Jr. | A63B 69/0062 |
| 12,128,268 | B1 * | 10/2024 | Biele | A61H 1/0237 |
| 2002/0137609 | A1 * | 9/2002 | Rosati | A63B 21/055 482/121 |
| 2005/0113222 | A1 * | 5/2005 | Dovner | A63B 21/00043 482/121 |
| 2005/0113223 | A1 * | 5/2005 | Dovner | A63B 21/0004 482/121 |
| 2005/0252717 | A1 | 11/2005 | Farrah et al. | |
| 2006/0183606 | A1 * | 8/2006 | Parmater | A63B 22/0076 482/132 |
| 2007/0287616 | A1 * | 12/2007 | Weaver | A63B 21/0552 482/121 |
| 2014/0342884 | A1 * | 11/2014 | Aldridge | A61H 1/0274 482/131 |
| 2016/0074699 | A1 * | 3/2016 | Walter | A63B 23/12 482/129 |
| 2017/0340919 | A1 | 11/2017 | Balan et al. | |
| 2020/0197743 | A1 * | 6/2020 | Biele | A63B 21/4025 |
| 2021/0113412 | A1 | 4/2021 | Holgate et al. | |
| 2023/0148095 | A1 | 5/2023 | Aref | |
| 2024/0017119 | A1 * | 1/2024 | Fazio | A63B 21/4007 |

* cited by examiner

SHOULDER HARNESS EXERCISE DEVICE WITH SPRING-LOADED FOOT RESTS

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to exercise devices, and more particularly to a portable abdominal exercise device.

BACKGROUND

Exercise devices for people have been developed to provide a variety of exercises for different parts of the body. Many of these devices are designed to provide resistance to the user's movements to increase the effectiveness of the exercise. Some exercise devices use springs as a resistance mechanism, while others use weights or hydraulic systems. However, many of these devices are bulky and expensive, making them unsuitable for home use or for people with limited space.

Other exercise devices are designed to be compact and portable, but they often lack the ability to provide sufficient resistance for a challenging workout. Additionally, many of these devices are not adjustable, making them unsuitable for people of different sizes and fitness levels.

Some exercise devices use elastic bands or cords as a resistance mechanism, but these devices can be difficult to use and do not facilitate the exercise of abdominal muscles and calve muscles in a manner that allows for a large number of repetitions at relatively low resistance while keeping the hands free. None of these approaches have provided a comprehensive solution that combines the features described in this disclosure.

There is, therefore, a need in the art for an exercise device that is compact, portable, adjustable, and provides sufficient resistance for a challenging workout, particularly for the abdominal and calve muscles. Such a needed invention would provide resistance throughout the range of motion and would not require frequent replacement of parts. The present invention accomplishes these objectives.

SUMMARY OF THE INVENTION

The present device is an exercise device for a person to perform exercises. The exercise device includes a shoulder harness adapted to fit around shoulders of the person, at least one spring mechanism, and at least one foot rest.

The exercise device is useful for doing exercises for strengthening abdominal muscles, for example crunches (engaging the "six-pack" muscles rectus abdominus, and oblique muscles) and sit-ups (engaging rectus abdominus, transversus abdominus, hip flexors, obliques, and lower abdominal muscles all at once). The exercise device is also useful for exercising calf muscles by pressing feet against the foot rest and flexing the feet at the ankle.

A further advantage of the exercise device includes quick interchange of the spring mechanism to adjust resistance. In addition to providing resistance for the abdominal exercises, the spring mechanism helps to smooth out movement during the abdominal exercises.

Additionally, the exercise device may be used in a "hands free" mode to enable simultaneous use of dumbbells to augment exercises with chest presses, chest fly, and arm curls (biceps, triceps). The "hands free" mode also enables a person to hold a phone or tablet device to do tasks while exercising.

An exercise device for a person has: a shoulder harness adapted to fit around shoulders of the person; at least one spring mechanism, each spring mechanism having a proximal end and a distal end, the proximal end configured for attaching with the shoulder harness; and at least one foot rest having two opposing ends, the at least one foot rest connected with the distal end of at least one of the spring mechanisms; whereby with the shoulder harness fitted around the shoulders of the person, and with the at least one foot rest engaged with one or more feet of the person, the person can press against the at least one foot rest with his feet to perform exercises.

The exercise device may include a rigid, elongated member having a first end, a second opposing end, the elongated member configured for attaching with the shoulder harness in front of the person and with the proximal end of the at least one spring mechanism, whereby the person grasps the elongated member while performing the exercises. The exercise device may include a backpack fixed with the shoulder harness, the backpack configured for storing the at least one spring mechanism and the at least one foot rest. The present device is an exercise device to assist the user in performing abdominal crunches, sit-ups, side crunches with ease. Since these movements are supported and aided by the shoulder harness and foot rest and spring or elastic band for resistance, the muscles won't be as fatigued. For this reason the exercises can be done for longer periods of time. This way the user will achieve the desired goal of tighter and stronger mid-section much faster.

Additionally while doing the abdominal exercises, the user's hand are free, which will enable them to do chest and shoulder exercises by the use of two dumbbells, or either use their free hands to go on their phone or tablet to do any task, while doing the abdominal exercises by their feet simultaneously.

Other features and advantages of the present invention will become apparent from the following more detailed description, taken in conjunction with the accompanying drawings, which illustrate, by way of example, the principles of the invention.

NUMBERING REFERENCE

Figure 1:
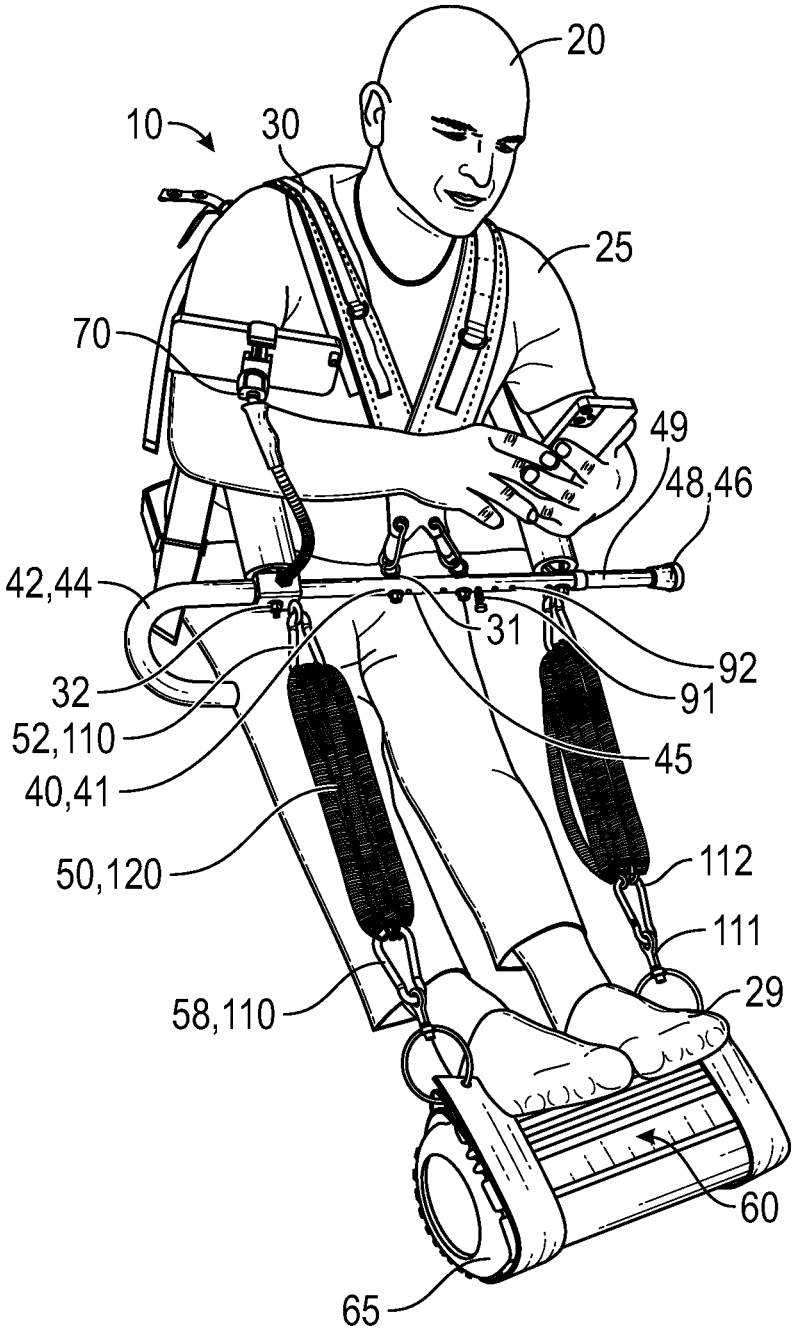
FIG. 1 is a perspective view of an exercise device of the invention shown in use with a person.

10 exercise device
20 person
25 shoulders of the person
29 feet of the person
30 shoulder harness
31 shoulder harness front connection points
32 shoulder harness rear connection points
40 elongated member
41 first portion of the elongated member
42 first end of the elongated member
44 cane handle
45 center point of elongated member
46 cane ground-engaging tip
48 second end of the elongated member
49 second portion of the elongated member
50 spring mechanism
52 spring mechanism proximal end
58 spring mechanism distal end
60 foot rest
61 center point of foot rest
65 foot rest opposing ends
70 electronic device holder
80 backpack
90 elongated member length adjustment mechanism
91 spring-biased button
92 button apertures
100 shoulder harness length adjustment mechanism
101 length adjustment mechanism buckle
102 length adjustment mechanism strap
110 ring and carabiner mechanism
111 ring
112 carabiner
120 coil spring
130 rubber resistance band
150 cushion

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, is but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 8:
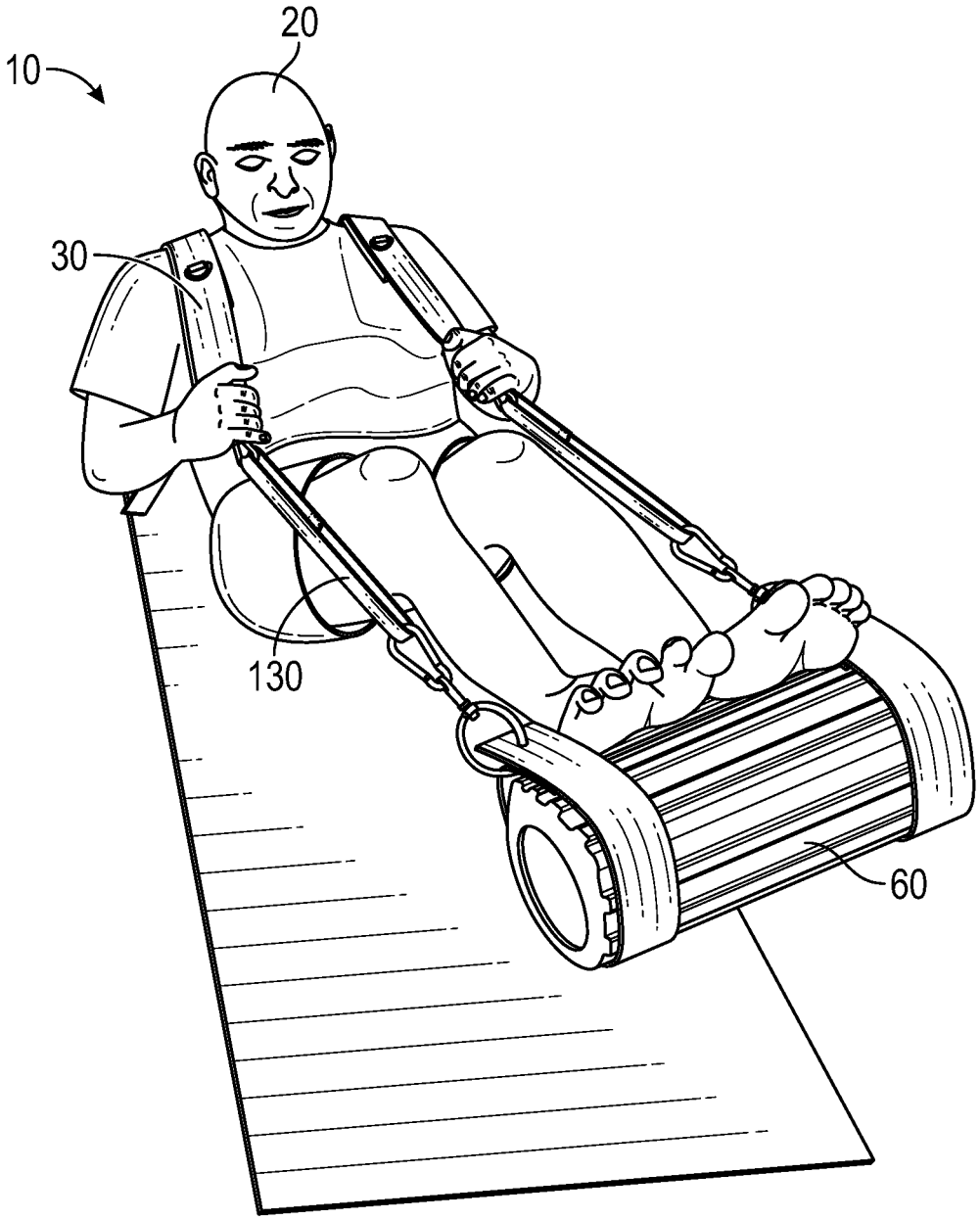
FIG. 8 is a perspective view of yet another embodiment of the exercise device of the invention.

FIGS. 1 and 8 illustrate an exercise device 10 of the invention for a person 20. Exercise device 10 includes a shoulder harness 30 adapted to fit around shoulders 25 of person 20. Exercise device 10 further includes at least one foot rest 60 having two opposing ends 65, the at least one foot rest 60 connected with the distal end 58 of at least one of the spring mechanisms 50 (FIG. 1). The shoulder harness may be, for example, a nylon material or the like.

Exercise device 10 further includes at least one spring mechanism 50, each spring mechanism 50 having a proximal end 52 and a distal end 58 (FIG. 1). The proximal end 52 of spring mechanism 50 is configured for attaching with the shoulder harness 25 (FIG. 8).

Exercise device 10 further includes at least one foot rest 60 having two opposing ends 65 (FIG. 1), the at least one foot rest 60 connected with the distal end 58 of the at least one spring mechanism 50.

When shoulder harness 30 is fitted around the shoulders 25 of the person 20, with the at least one foot rest 60 engaged with one or more feet 29 of person 20, the person can press against the at least one foot rest 60 with one or more feet 29 to perform exercises (FIG. 1).

Figure 2:
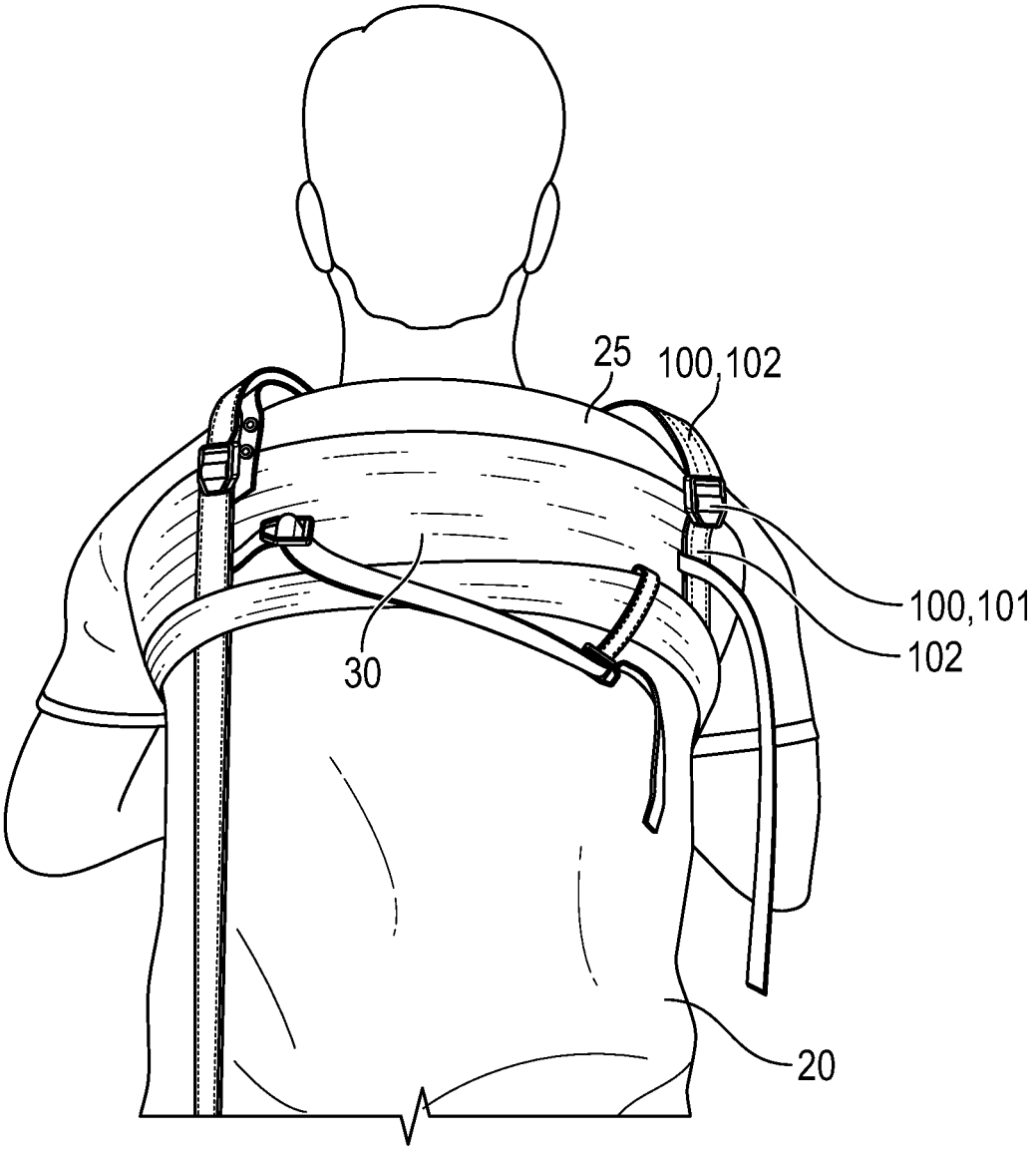
FIG. 2 is a rear elevational view of the exercise device of the invention showing a shoulder harness in use with a person.

In preferred embodiments, exercise device 10 may include an elongated member 40 (FIG. 2). Elongated member 40 may be rigid and includes a first end 42 and a second opposing end 48. Elongated member 40 is configured for attaching to shoulder harness 30 in front of person 20 and with the proximal end 52 of the at least one spring mechanism 50, whereby the person grasps elongated member 40 while performing the exercises. The elongated member may be constructed of any suitably strong material, including, for example, a metal or a heavy plastic.

In some embodiments of the invention, elongated member 40 may include a length adjustment mechanism. The length adjustment mechanism may include a first portion 41 of elongated member 40 slidably engaged with a second portion 49 of elongated member 40 (FIG. 2). The first portion 41 is interconnected with the second portion 49 at a spring-biased button 91 of the first portion 41 configured for traversing one of a plurality of button apertures 92 in second portion 49 of elongated member 40 (FIG. 2). The length of elongated member 40 may thus be adjusted to various lengths by sliding first portion 41 relative to second portion 49 to position spring-biased button 91 at various button apertures 92.

In some embodiments of exercise device 10, elongated member 40 may include a cane handle 44 at first end 42 of elongated member 40 and a ground engaging tip 46 at the opposing second end 49 of elongated member 40 (FIG. 1). Cane handle 44 may have a curved shape as shown in FIG. 1 or any other suitable shape for the person to carry exercise device 10 (for example, as in FIG. 5).

In some embodiments of the invention, exercise device 10 may include an electronic device holder 70 (FIG. 2). Electronic device holder 70 may be fixed with the elongated member 40. Electronic device holder 70 may be flexible (for example, including a flexible metal or polymeric gooseneck) to allow for positioning of an electronic device to permit, for example, person 20 to view a screen of the electronic device during exercise. In some embodiments, electronic device holder 70 may be removably fixed to elongated member 40 (for example, with a suitable bracket) for inclusion as an optional component.

Figure 3:
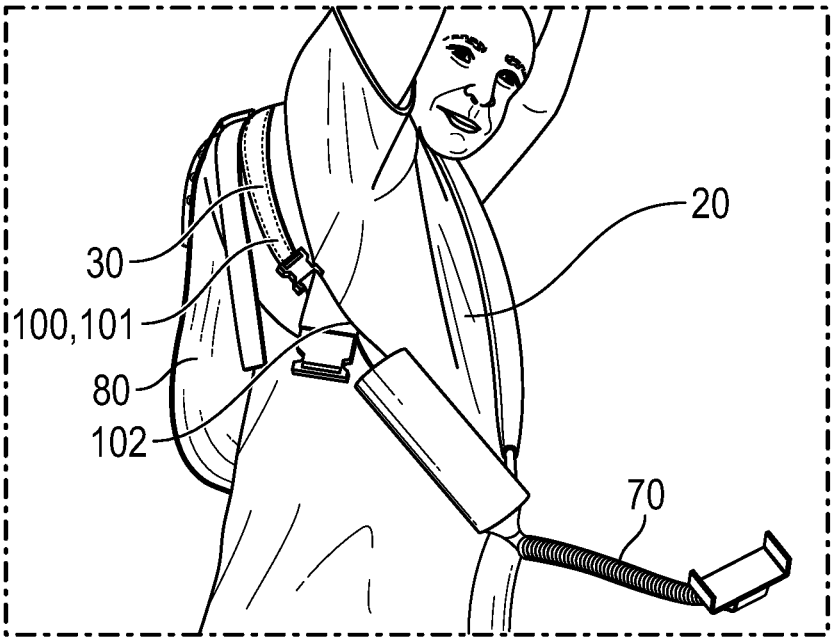
FIG. 3 is a lateral elevation view of an embodiment of the exercise device of the invention in use with a person, showing the shoulder harness with a backpack and length adjustment mechanism.

In some embodiments of exercise device 10, shoulder harness 30 may include a length adjustment mechanism 100 (FIGS. 2 and 3). Length adjustment mechanism 100 may include a buckle 101 and at least two straps 102 (FIGS. 2 and 3). The straps may be, for example, a nylon material or the like.

In some embodiments of the exercise device 10, the device includes the elongated member 40 and the shoulder harness may include at least one front connection point 31 and two rear connection points 32 (FIG. 1). The at least one front connection point 31 may be fixed to the elongated member 40 proximate a center point 45 thereof, and the two rear connection points 32 may be connected proximate the first end 41 and second, opposing end 49 of elongated member 40 (FIG. 1).

Figure 4:
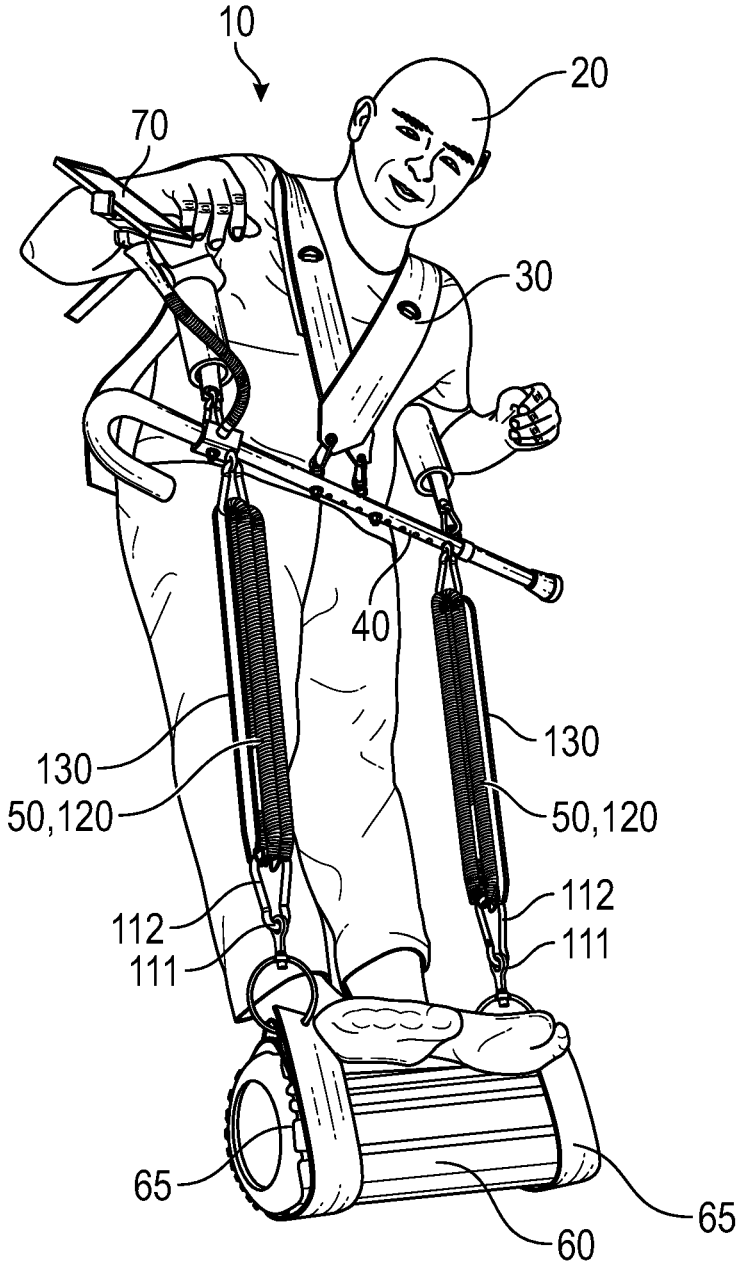
FIG. 4 is a perspective view of another embodiment of the exercise device of the invention.

In some embodiments, the exercise device 10, the at least one spring mechanism 50 may include at least one coil spring 120 (FIGS. 1, 4, 6, and 7). In some embodiments, the at least one spring mechanism 50 may include at least one elongated elastomeric member 130 (FIG. 4).

Figure 5:
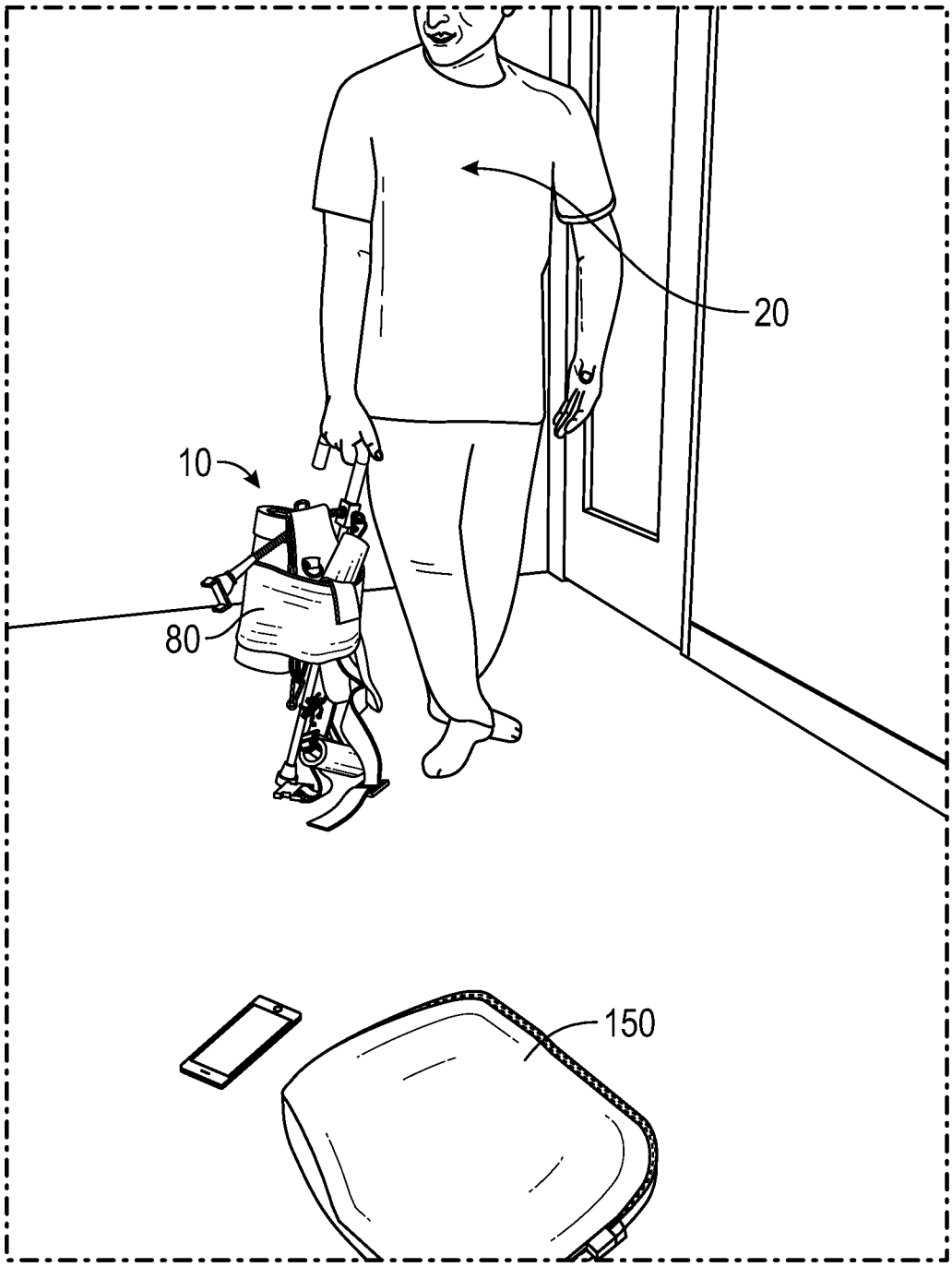
FIG. 5 is a perspective view of another embodiment of the exercise device of the invention, shown with at least one spring mechanism and at least one foot rest stored in a backpack fixed to the shoulder harness.

In some embodiments of the invention, exercise device 10 may include a backpack 80 fixed with shoulder harness 30 (FIG. 3). Backpack 80 may be useful for storing components of exercise device 10, for example, the at least one spring mechanism 50, the at least one foot rest 60, and optionally even elongated member 40 (FIG. 5).

Figure 6:
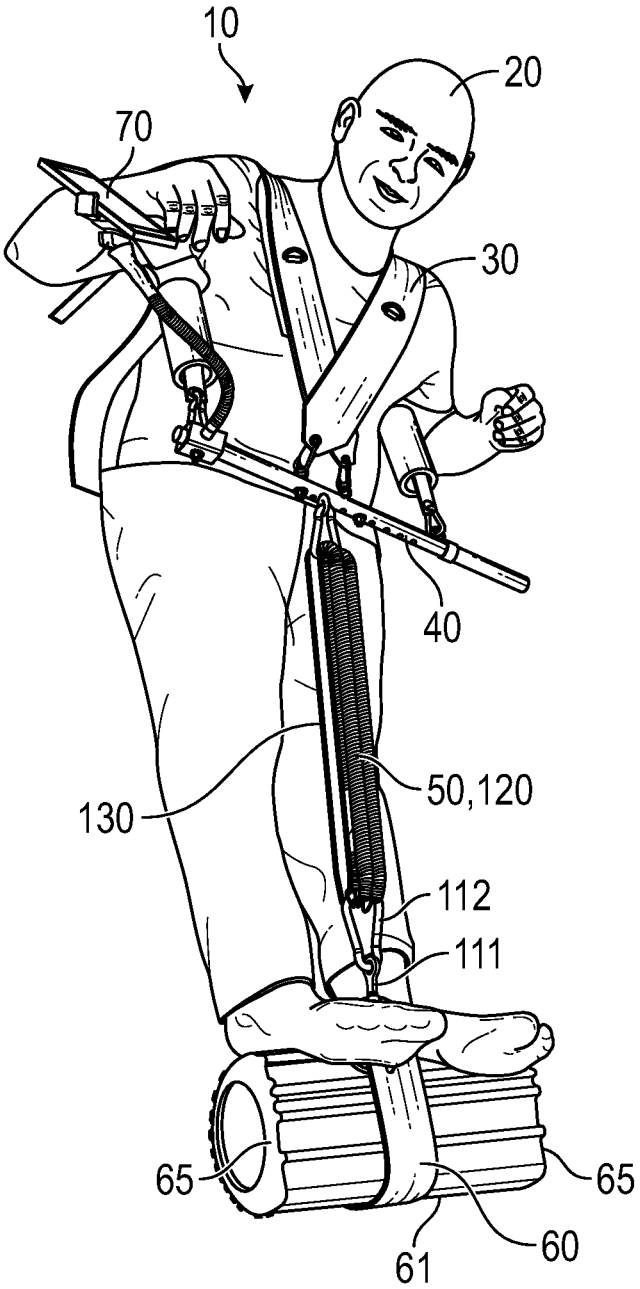
FIG. 6 is a perspective view of yet another embodiment of the exercise device of the invention.

In some embodiments of exercise device 10, the at least one spring mechanism 50 may include exactly one spring mechanism 50 and the at least one foot rest 60 may include exactly one foot rest 60 (FIG. 6). In this embodiment, proximal end 52 of the exactly one spring mechanism 50 may be fixed at center point 45 of elongated member 40, and distal end 58 of the exactly one spring mechanism 50 may be fixed at a center point 61 of the exactly one foot rest 60, such that the feet 29 of the person 20 may press against the foot rest 60 on either side of the spring mechanism 50.

Figure 7:
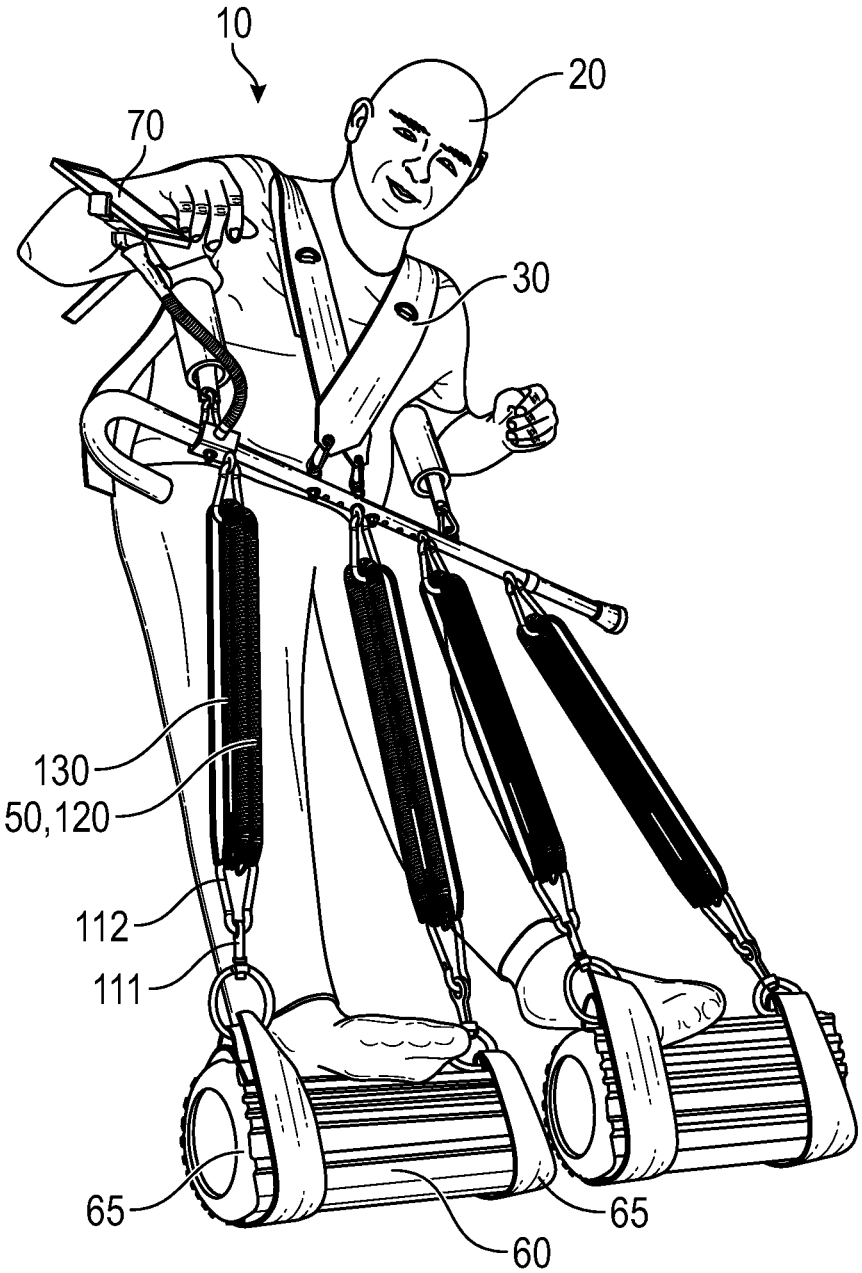
FIG. 7 is a perspective view of yet another embodiment of the exercise device of the invention.

In another embodiment of the invention, exercise device 10 may include exactly two of the foot rests 60, and the at least one spring mechanism 50 includes exactly four of the spring mechanisms 50, and the distal ends of the spring mechanisms 50 are each fixed with one of the opposing ends of one of the foot rests 60, such that feet 29 of person 20 may press against each foot rest 60 independently to extend each spring mechanism 50 independently (FIG. 7).

In some embodiments, the exercise device 10 may be part of a kit, which typically includes a set of instructions for use and care for the exercise device. The kit may include a cushion 150, for added comfort to the person while using the exercise device. The kit may include additional accessories, for example, adapter(s) for holding various sizes and shapes of electronic device 70 (e.g., a smart phone or tablet device), an identification tag, and a cover or sack for storage of the entire device and accessories.

Methods of using exercise device 10 of the invention may include various abdominal exercise performed on the floor. In one embodiment, a person wearing exercise device 10 may perform a sit-up or crunch exercise with a rocking motion back and forth, and the at least one spring mechanism 50 helps to smooth out movement of the exercise device. In another embodiment, a leg-raise exercise may be performed by keeping the person's back against the floor and raising one or two legs. In another embodiment, the person may perform a sit-up including a twist to one side to exercise oblique muscles.

Methods of using exercise device 10 to enhance a person's exercise are not limited to the above embodiments, which are examples provided to illustrate advantages and utility of exercise device 10.

In some embodiments, methods of using exercise device 10 can include the person having arms and hands free to hold weights (e.g., dumbbell weights) and perform various exercises such as chest press, chest fly, and arm curls for either biceps or triceps. With the ability to simultaneously perform arm/chest exercises in addition to sit-ups, crunches and the like, a more efficient use of workout time may be achieved.

In a further embodiment, a person using the exercise device 10 in a "hands free" mode is enabled to hold a phone or tablet device while exercising.

In a further embodiment, a person may exercise his calf muscles by placing feet 29 on the at least one foot rest 60 and flexing his feet at the ankle.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise device for a person, comprising:

a shoulder harness adapted to fit around shoulders of the person;

at least one spring mechanism, each spring mechanism having a proximal end and a distal end;

at least one foot rest having two opposing ends, the at least one foot rest connected with the distal end of at least one of the spring mechanisms; and an elongated member being rigid and having a first end and a second opposing end, and being connected with the shoulder harness, the elongated member attached with the proximal end of the at least one spring mechanism such that the elongated member is non-rigidly attached with the at least one foot rest;

whereby with the shoulder harness fitted around the shoulders of the person, and with the at least one foot rest engaged with one or more feet of the person, the person can press against the at least one foot rest with his feet to perform exercises; and whereby the elongated member is configured to be positioned in front of and grasped by the person while performing the exercises.

2. The exercise device of claim 1 further including an electronic device holder fixed with the elongated member.

3. The exercise device of claim 1 further including a backpack fixed with the shoulder harness, the backpack configured for storing the at least one spring mechanism and the at least one foot rest.

4. The exercise device of claim 3 wherein the backpack is configured for further storing the elongated member.

5. The exercise device of claim 1 wherein the elongated member includes a length adjustment mechanism.

6. The exercise device of claim 5 wherein the length adjustment mechanism includes a first portion of the elongated member telescopically slidably engaged with a second portion of the elongated member, the first portion interconnected with the second portion at a spring-biased button of the first portion configured for traversing one of a plurality of button apertures in the second portion.

7. The exercise device of claim 6 wherein the elongated member includes a cane handle at the first end and a cane ground-engaging tip at the second opposing end.

8. The exercise device of claim 1 wherein the at least one foot rest includes exactly one foot rest, and wherein the at least one spring mechanism includes exactly two of the spring mechanisms, the distal end of each spring mechanism fixed with one of the ends of the foot rest, such that the feet of the person may press down on the foot rest to extend each spring mechanism.

9. The exercise device of claim 8 wherein each distal end of each spring mechanism is fixed with one of the opposing ends of the foot rest at a ring and carabiner mechanism.

10. The exercise device of claim 8 wherein each proximal end of each spring mechanism is fixed with the elongated member at a ring and carabiner mechanism.

11. The exercise device of claim 1 wherein the shoulder harness includes at least one front connection point and two rear connection points, the at least one front connection point fixed with the elongated member proximate to a center point thereof, and the two rear connection points connected proximate to the first end and the second opposing end of the elongated member.

12. The exercise device of claim 11 wherein the at least one spring mechanism includes an elongated elastomeric member.

13. The exercise device of claim 1 wherein the shoulder harness includes a length adjustment mechanism.

14. The exercise device of claim 13 wherein the length adjustment mechanism includes a buckle and at least two straps.

15. The exercise device of claim 1 wherein the at least one spring mechanism includes at least one coil spring.

16. The exercise device of claim 1 wherein the at least one foot rest includes exactly one foot rest, and wherein the at least one spring mechanism includes exactly one of the spring mechanisms, the distal end of the spring mechanism fixed with a center point of the foot rest, such that the feet of the person may press down on the foot rest on either side of the spring mechanism to extend the spring mechanism.

17. The exercise device of claim 1 wherein the at least one foot rest includes exactly two of the foot rests, and wherein the at least one spring mechanism includes exactly four of the spring mechanisms, the distal ends of the spring mechanisms each fixed with one of the opposing ends of one of the foot rests, such that the feet of the person may press down on each foot rest independently to extend each spring mechanism independently.

* * * * *